US008011399B2

(12) United States Patent
Chang

(10) Patent No.: US 8,011,399 B2
(45) Date of Patent: Sep. 6, 2011

(54) WOODWORKING BENCH

(76) Inventor: Lee-Cheng Chang, Taichung (TW)

( * ) Notice: Subject to any disclaimer, the term of this patent is extended or adjusted under 35 U.S.C. 154(b) by 655 days.

(21) Appl. No.: 11/747,302

(22) Filed: May 11, 2007

(65) Prior Publication Data

US 2008/0277025 A1 Nov. 13, 2008

(51) Int. Cl.
*B25H 1/00* (2006.01)

(52) U.S. Cl. ..... 144/286.5

(58) Field of Classification Search ..... 144/286.1, 144/286.5, 287; 108/131, 132, 135, 142, 108/13, 151, 115, 11, 34, 35, 36, 38, 64, 108/65, 68, 69, 66, 89, 90, 143, 137; 83/471, 83/781, 477.2, 477, 446, 490, 581, 953
See application file for complete search history.

(56) References Cited

U.S. PATENT DOCUMENTS

| | | | | | |
|---|---|---|---|---|---|
| 1,864,840 | A * | 6/1932 | Lehner | 144/287 |
| 2,697,458 | A * | 12/1954 | Cue | 83/471 |
| 2,699,977 | A * | 1/1955 | Breslow | 108/35 |
| 3,042,468 | A * | 7/1962 | Rudow et al. | 108/83 |
| 3,080,832 | A * | 3/1963 | Schroemges | 108/13 |
| 3,099,232 | A * | 7/1963 | Cooper | 108/83 |
| 3,429,347 | A * | 2/1969 | Klein | 83/435.27 |
| 3,476,912 | A * | 11/1969 | Garrison | 219/213 |
| 3,515,077 | A * | 6/1970 | Glowacki | 108/89 |
| 3,872,755 | A * | 3/1975 | Marsh et al. | 83/471.3 |
| 4,209,045 | A * | 6/1980 | Bassett | 144/48.7 |
| 4,406,200 | A * | 9/1983 | Kerr | 83/473 |
| 4,566,510 | A * | 1/1986 | Bartlett et al. | 144/48.3 |
| 4,726,405 | A * | 2/1988 | Bassett | 144/287 |
| 4,955,941 | A * | 9/1990 | Rousseau | 108/65 |
| 5,024,257 | A * | 6/1991 | Lloyd | 144/1.1 |
| 5,398,740 | A | 3/1995 | Miller | 144/286 |
| 5,584,254 | A * | 12/1996 | Williams | 108/118 |
| 5,709,256 | A * | 1/1998 | Thormeier | 144/286.1 |
| 5,819,671 | A | 10/1998 | Ocampo | 108/64 |
| 5,931,209 | A * | 8/1999 | Chang | 144/287 |
| 6,494,307 | B1 * | 12/2002 | Kozak et al. | 198/465.1 |
| 6,508,281 | B1 * | 1/2003 | Wang | 144/287 |
| 6,644,370 | B2 * | 11/2003 | Aigner | 144/287 |
| 7,047,856 | B2 * | 5/2006 | Nurenberg et al. | 83/471.3 |
| 2003/0213349 | A1 * | 11/2003 | Chang | 83/438 |
| 2005/0217446 | A1 * | 10/2005 | Brazell et al. | 83/477.2 |
| 2006/0208409 | A1 * | 9/2006 | Thibaut et al. | 269/73 |
| 2007/0029011 | A1 * | 2/2007 | Thatcher | 144/286.5 |

OTHER PUBLICATIONS

Taiwanese M 586488, 6 pages.
UK Patent Publication No. GB 1353830 A, May. 22, 1974, 8 pages.
UK Patent Publication No. GB 2246407 A, Jan. 29, 1922, 18 pages.
Taiwanese Utility model Publication No. TW M283161, Dec. 11, 2005, 6 pages.

* cited by examiner

*Primary Examiner* — David Walczak
*Assistant Examiner* — Jennifer Chiang
(74) *Attorney, Agent, or Firm* — Alan Kamrath; Kamrath & Associates PA

(57) ABSTRACT

A woodworking bench includes a table made of granite and mounted on a base of a woodworking machine. A table extension is mounted to a side of the table and made of granite. The side of the table includes two first tracks mounted therein. The table extension includes a side having two second tracks mounted therein and respectively aligned with the first tracks of the table. Two supporting rods each has a first end slidably received in one of the first tracks and a second end slidably received in one of the second tracks. At least one adjusting member is mounted to the second end of each supporting rod for adjusting coplanarity of a top face of the table and a top face of the table extension.

12 Claims, 8 Drawing Sheets

WOODWORKING BENCH

BACKGROUND OF THE INVENTION

The present invention relates to a woodworking bench and, more particularly, to a woodworking bench that is made of granite and that allows adjustment of coplanarity between a table and a table extension of the bench.

People's taste of living environment changes due to a significant increase in living standards. Taking televisions as an example, conventional CRT type televisions have been replaced by desk liquid crystal televisions, flat panel televisions, and plasma televisions. To provide an aesthetically pleasing appearance, strips representing wood grain are bonded to a metal television casing. Also, televisions with wooden casings are also proposed to blend in the living environment.

Many families in the United States love do-it-yourself projects and are willing to buy tools and machines for processing lumber, including band-saw machines, circular saw machines, planers, etc., which can be classified into either a desk type or a floor type. Yet, all of such machines include a bench or table for processing lumber. The table is generally made of metal such as cast iron.

Taiwan Utility Model Publication No. 586488 discloses a band saw table and a table extension mounted by two connecting rods to a side of the band saw table to increase the working area. Retaining screws are mounted to a bottom side of the table to tighten the connecting rods. The distance between the table extension and the table can be adjusted when the retaining screws are loosened. The table and the table extension cannot blend in the living environment of a person as a matter of taste, as the table and the table extension are made of metal and give a hard, cold impression. Furthermore, the table and the table extension are generally made of cast iron, which, when impacted, is liable to have scratches on the surface, leading to adverse affect to the coplanarity between the table and the table extension.

Furthermore, the table and the table extension made of cast iron having a high conductivity factor are susceptible to temperature and moisture while having poor abrasive resistance and being apt to rust. Regular maintenance is required to avoid poor precision, leading to high maintenance costs. Further, the retaining screws cannot provide effective retaining effect for the table extension. Specifically, in a case that the work piece to be cut on the table extension is heavy, the table extension moves together with the work piece during movement of the work piece. Further, the connecting rods are pushed upward by the retaining screws, resulting in upward inclination of the table extension. Thus, the upper face of the table extension may not be coplanar with the upper face of the table, leading to adverse affect to cutting.

It is, therefore, a need for a woodworking bench that is durable and that requires less maintenance.

BRIEF SUMMARY OF THE INVENTION

The present invention solves this need and other problems in the field of woodworking benches by providing, in a preferred form, a woodworking bench including a table made of granite and mounted on a base of a woodworking machine. The base may include a transmission mechanism and a cutter mechanism driven by the transmission mechanism. A table extension is mounted to a side of the table and made of granite. The side of the table includes two first tracks mounted therein. The table extension includes a side having two second tracks mounted therein and respectively aligned with the first tracks of the table. Two supporting rods each has a first end slidably received in one of the first tracks and a second end slidably received in one of the second tracks. At least one adjusting member is mounted to the second end of each supporting rod for adjusting coplanarity of a top face of the table and a top face of the table extension. Another table extension can be mounted to the other side of the table opposite to the side of the table.

The second end of each supporting rod includes at least one adjusting hole for receiving the at least one adjusting member. In the most preferred form, the adjusting hole is a screw hole, and the adjusting member is a screw.

The side of the table includes two engaging grooves in which the first tracks are fixed, and the side of the table extension includes two grooves in which the second tracks are fixed.

Two screws are provided to fix each first track in each engaging groove of the table. The table further includes two holes in a bottom wall defining each engaging groove. A sleeve is mounted in each hole of the bottom wall and has a screw hole. Each first track includes two through-holes aligned with the screw hole of the associated sleeve. Each screw extends through one of the through-holes of each first track into the screw hole of the associated sleeve.

In the most preferred form shown, the side of the table further includes a plurality of fixing holes. The table extension includes an underside having a plurality of recesses. A fastener is mounted in each recess and extends into one of the fixing holes of the table. Each recess is spaced from the side of the table extension by an end wall. Each recess includes a first, wider section adjacent to the end wall and a second, narrower section distant to the end wall. A first sleeve is fixed in each fixing hole of the table and has a screw hole. A through-hole is defined in the end wall. A second sleeve is mounted in the through-hole and has a screw hole. Each fastener includes a threaded section extending through the screw hole of the second sleeve in the table extension into the screw hole of the first sleeve in the table.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
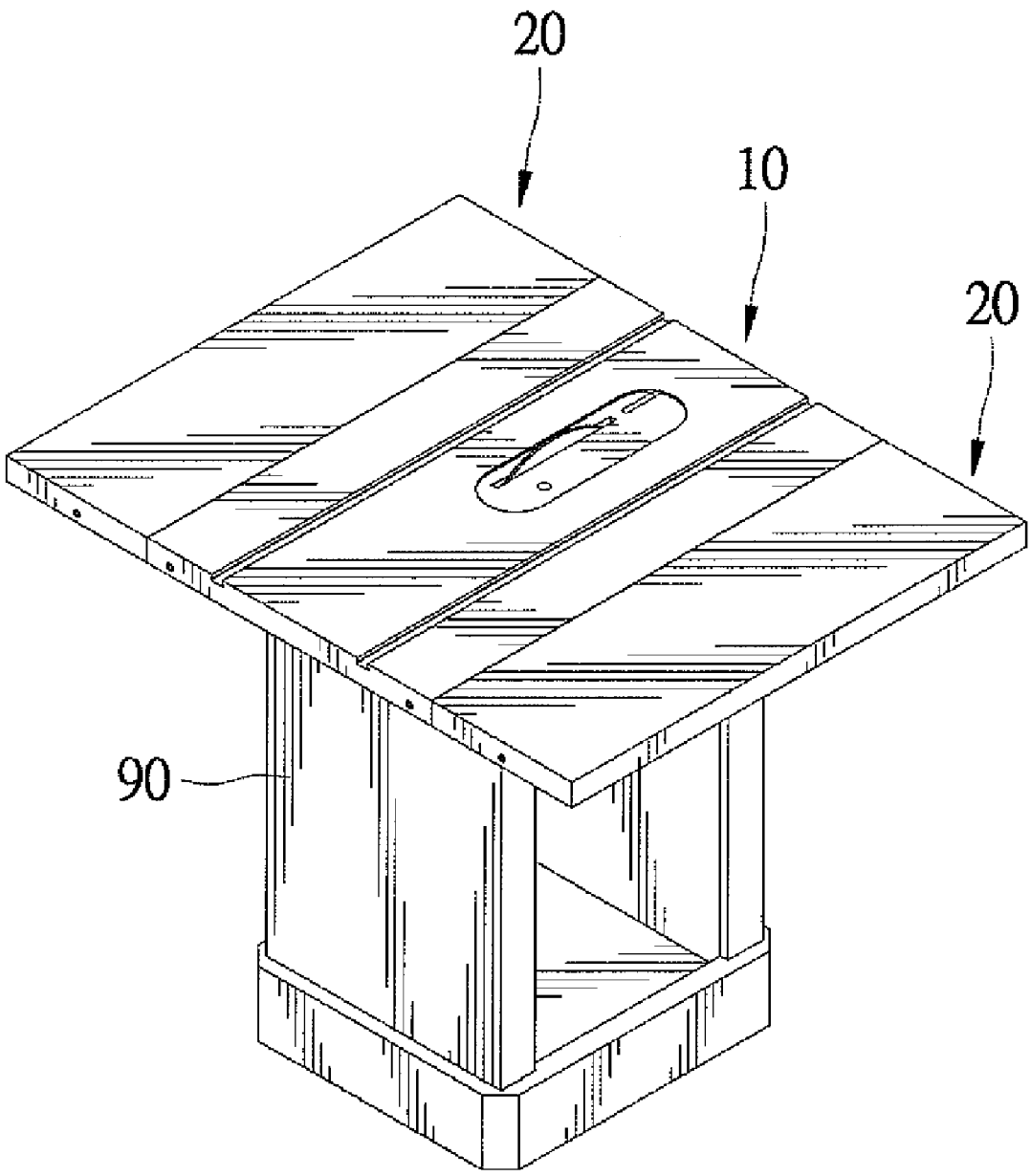
FIG. 1 shows a diagrammatic perspective view of a woodworking machine according to the preferred teachings of the present invention.
Figure 2:
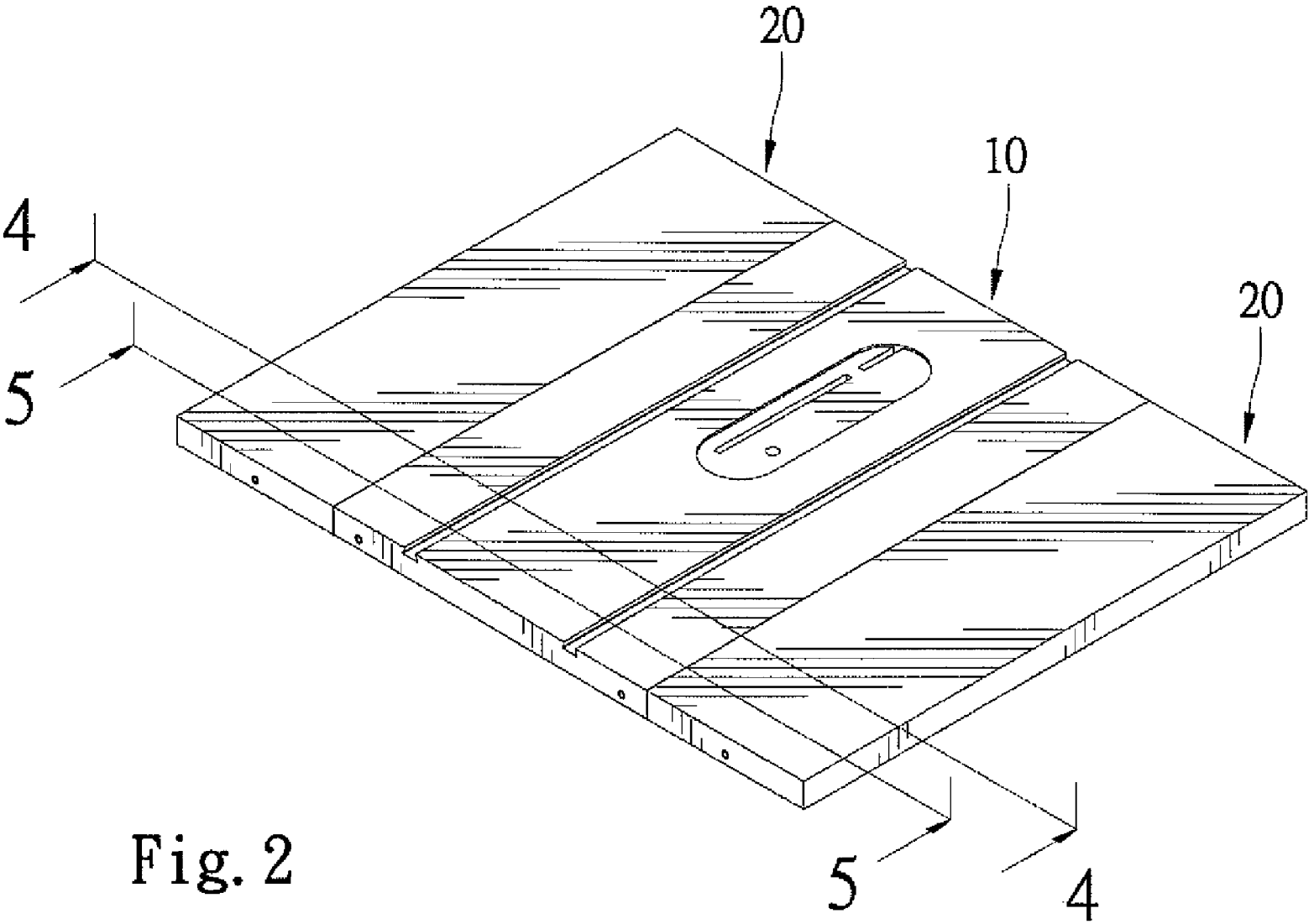
FIG. 2 shows a perspective view of the woodworking bench of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "upper", "top", "underside", "end", "portion", "longitudinal", "outward", "inward", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A woodworking bench according to the preferred teachings of the present invention is shown in the drawings and generally includes a table 10 mounted on a base 90. Two table extensions 20 are respectively mounted to two opposite sides 102 of the table 10. The table 10 is rectangular in section and made of granite that has the hardest and the most uniform structure among rocks. Furthermore, granite is resistant to acids and alkalis and is durable to weathering. Furthermore, granite can resist pressure up to 2000 g/cm$^2$. Granite contains more than 90% of feldspar and quartz that are so hard that even a steel knife cannot leave a scar on their surfaces. Further, granite is difficult to deform and has a long life. The abrasive resistance and hardness of granite are respectively eight times and 2.5 times of those of cast iron. Temperature and moisture have little influence on granite. Further, granite has no inner stress but has excellent erosive resistance, is not conductive to magnetism and is difficult to adhere. Further, granite is difficult to rust but easy to clean. In a case that grains fall from the surface of granite due to impact and leaves a hole in the surface, the planarity of the surface is scarcely affected, as the perimeter of the hole would not protrude outward. Further, granite has excellent resistance to shock. Other physical and mechanical properties of granite include: specific weight >2.8 g/cm; moisture content: <0.05%; and Moh's hardness: between 5 and 7.

The table 10 includes a top face 101 serving as the working surface. Each side 102 of the table 10 includes two engaging grooves 11 extending inward in a direction perpendicular to a longitudinal direction of the side 102. A bottom wall defining each engaging groove 11 includes two holes 18 spaced in the extending direction of the engaging groove 11. A sleeve 14 is fixed in each hole 18 and includes a screw hole (not labeled). A track 12 is fixed in each groove 11 and is substantially C-shaped in section. The track 12 includes an intermediate portion (not labeled) having two through-holes 19 that are aligned with the screw holes of the sleeves 14. A screw 13 is extended through each through-hole 19 in the track 12 into the screw hole of an associated sleeve 14, thereby fixing the track 12 in the associated groove 11. The sleeves 14 are made of stainless steel. Each side 102 further includes a plurality of fixing holes 15 extending in a direction perpendicular to the longitudinal direction of the side 102. A sleeve 16 is fixed in each fixing hole 15, is made of stainless steel and has a screw hole (not labeled).

The table extensions 20 are mounted to the sides 102 of the table 10 to increase the area of the working surface. Each table extension 20 is rectangular in section and also made of granite. Each table extension 20 includes a top face 201 serving as the working surface. Each table extension 20 further includes a side 202 in surface contact with the side 102 of the table 10 and has two grooves 21 respectively aligned with the engaging grooves 11 of the table 10. A track 22 is mounted in each groove 21 and is substantially C-shaped in section. A supporting rod 23 includes a first end slidably received in one of the tracks 12 of the table 10 and a second end slidably received in one of the tracks 22 of one of the table extensions 20. Each supporting rod 23 is substantially T-shaped in section. Two adjusting members 24 are mounted to the second end of each supporting rod 23 for adjusting coplanarity between the top face 201 of the table extension 20 and the top face 101 of the table 10. The second end of each supporting rod 23 includes two adjusting holes 231 extending from an underside through an upper side of the supporting rod 23. In the most preferred form shown, each adjusting member 24 is in the form of a screw and each adjusting hole 231 is a screw hole in which an adjusting member 24 is threadedly engaged. By turning the adjusting members 24, the coplanarity between the top face 201 of each table extension 20 and the top face 101 of the table 10 can be adjusted. It is noted that more or a fewer number of adjusting members 24 and adjusting holes 231 can be utilized.

Figure 3:
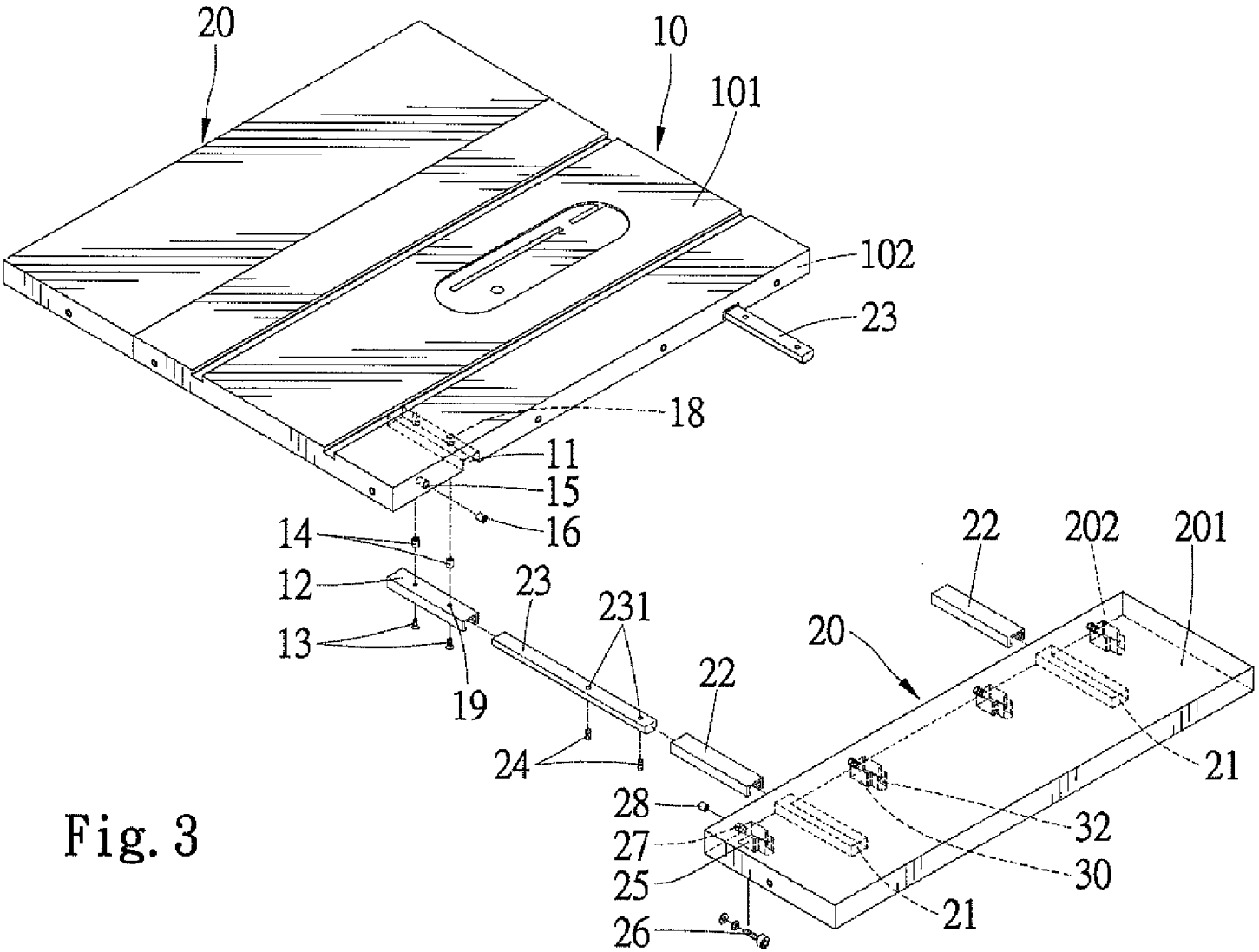
FIG. 3 shows an exploded perspective view of the woodworking bench of FIG. 2.
Figure 4:
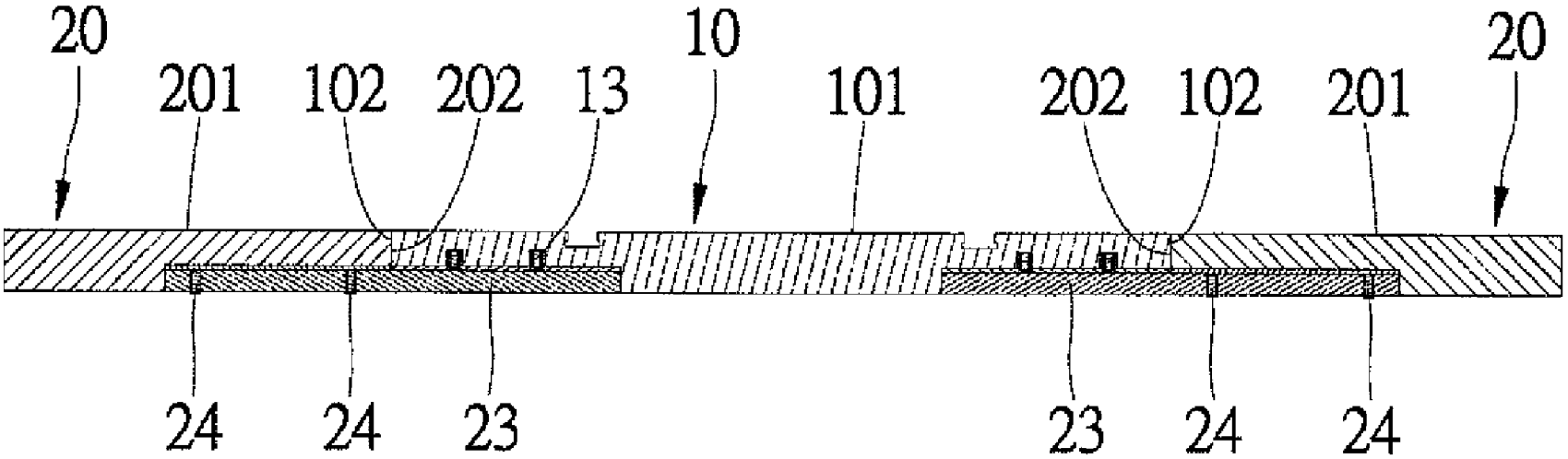
FIG. 4 shows a sectional view taken along plane 4-4 of FIG. 2.
Figure 5:
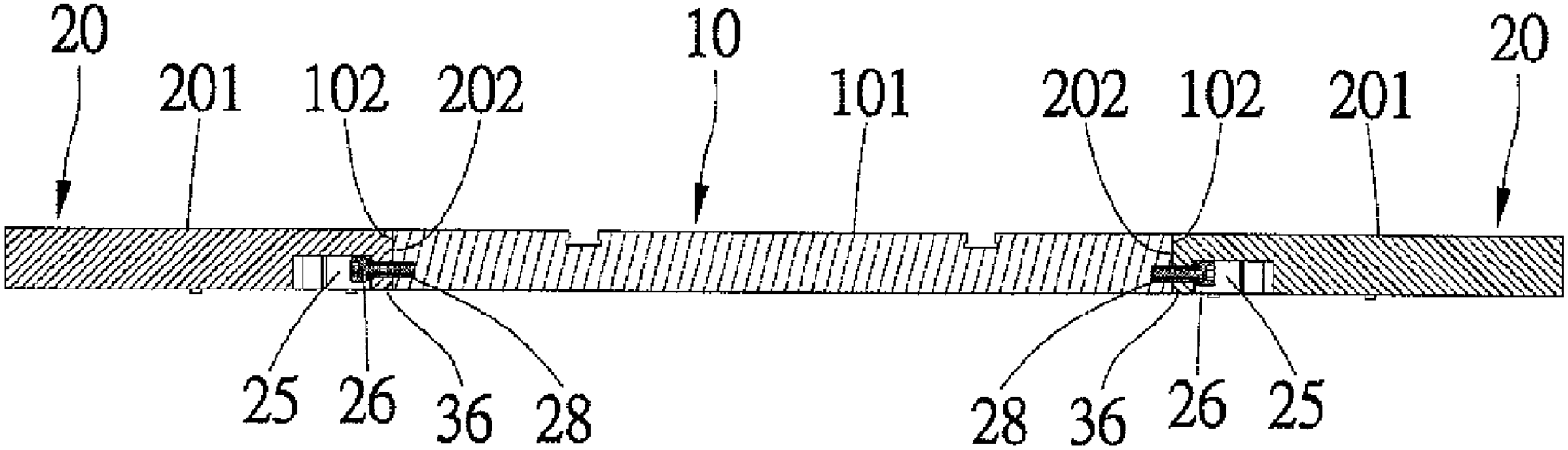
FIG. 5 shows a sectional view taken along plane 5-5 of FIG. 2.

With reference to FIGS. 3 and 5, the side 202 of each table extension 20 further includes a plurality of recesses 25 in an underside thereof and respectively aligned with the fixing holes 15. Each recess 25 is substantially T-shaped in section and spaced from the side 202 of the table extension 20 by an end wall 36. Each recess 25 includes a first, wider the end wall 36 of the table extension 20 and a second, narrower section 32 distant to the end wall 36 of the table extension 20. A through-hole 27 extends through the end wall 36 of the table extension 20 and is in communication with the first, wider section 30. A sleeve 28 is fixed in each through-hole 27 and is made of stainless steel. A fastener 26 has a threaded section extending through each sleeve 28 into an associated sleeve 16. Thus, the table extension 20 can be securely attached to the side 102 of the table 10.

Figure 6:
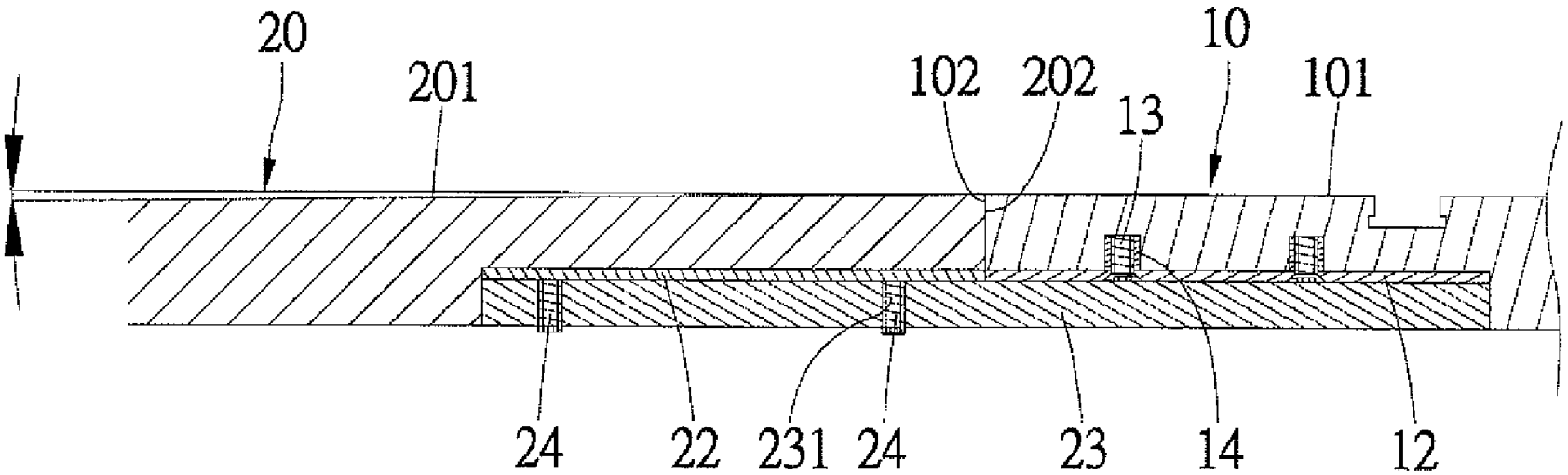
FIG. 6 is a partial enlarged view of a portion of the bench of FIG. 4, illustrating adjustment of coplanarity of a table and a table extension of the woodworking bench.
Figure 7:
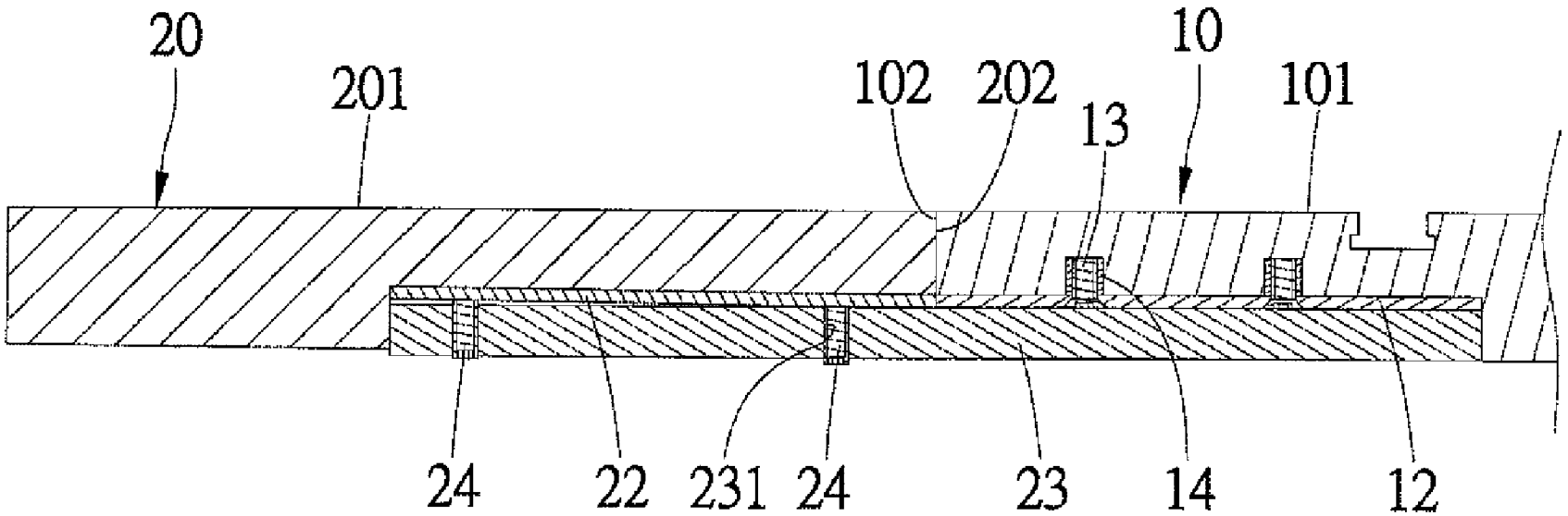
FIG. 7 is a view similar to FIG. 6, illustrating the table and the table extension after adjustment.

With reference to FIGS. 6 and 7, when the table extensions 20 are fixed to the sides 102 of the table 10, the adjusting members 24 can be turned to proceed with microadjustment until the top face 201 of each table extension 20 is coplanar with the top face 101 of the table 10.

Figure 8:
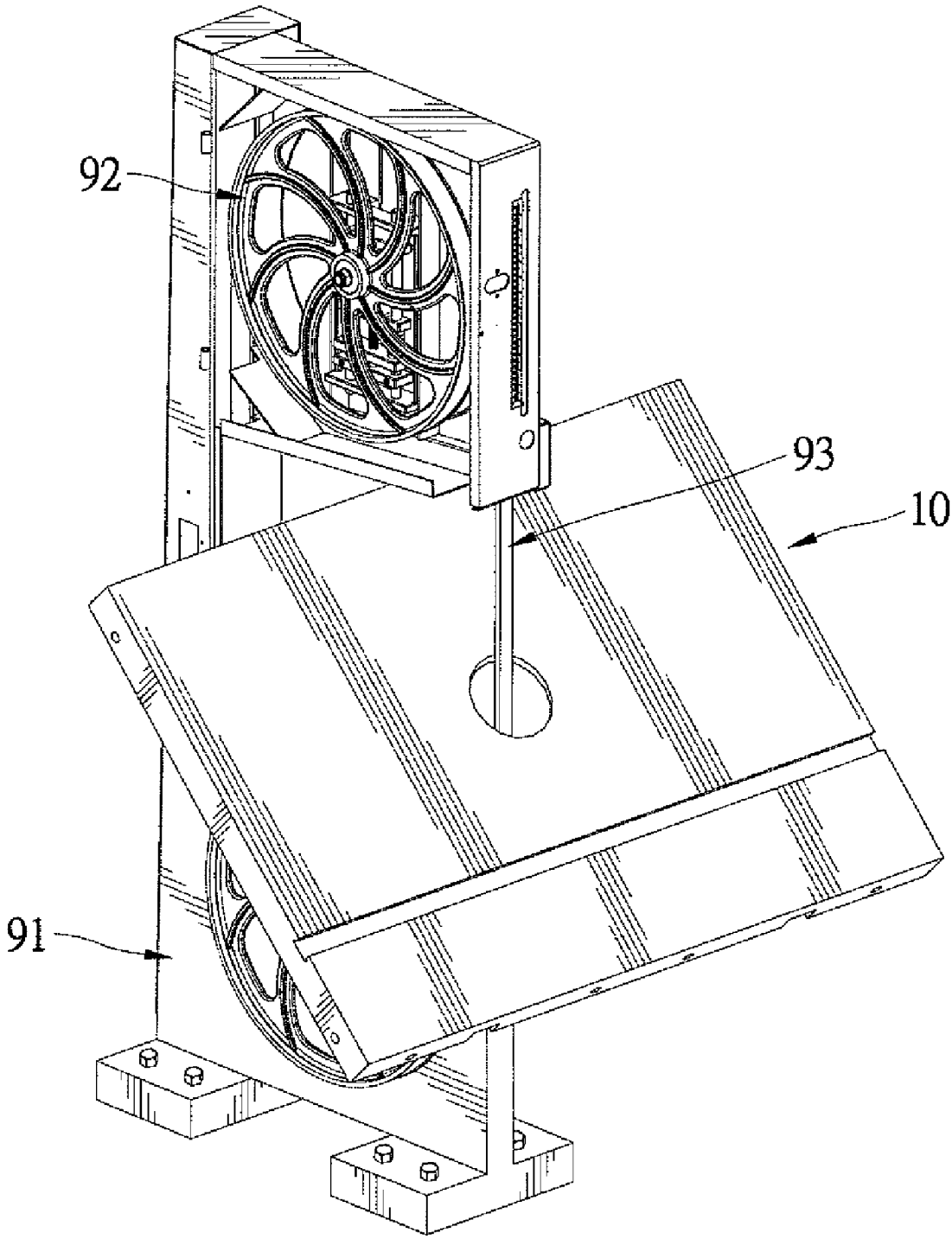
FIG. 8 shows use of the table according to the preferred teachings of the present invention on a floor type band-saw machine.

FIG. 8 shows use of the table 10 according to the preferred teachings of the present invention on a base 91 of a floor type band-saw machine. A transmission mechanism 92 and a cutter mechanism 93 driven by the transmission mechanism 92 are mounted in the base 91, which are conventional.

The table 10 and the table extensions 20 are made of granite that is difficult to deform, has a long life and has hardness 2.5 times of that of cast iron. Further, granite is difficult to rust but easy to clean and to maintain. Further, the adjusting members 24 on the supporting rods 23 allow adjustment of coplanarity between the top face 101 of the table 10 and the top faces 201 of the table extensions 20. Further, the table extensions 20 can be securely fixed to the sides 102 of the table 10 by extending fasteners 26 through the recesses 25 and through-holes 27 in the underside of the table extensions 20 into the fixing holes 15 of the table 10.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A woodworking bench comprising, in combination:

a table having a top face, a side extending from the top face and a bottom face extending from the side parallel to and spaced from the top face, with the table being mounted on a base of a woodworking machine;

a table extension having a top face, a first side extending from the top face of the table extension, a bottom face extending from said first side of the table extension parallel to and spaced from the top face of the table extension, and a second side extending between the top and bottom faces of the table extension spaced an extension distance from the first side, with the side of the table abutting with said first side of the table extension;

two first tracks mounted in the table, with the bottom face of the table comprising two engaging grooves extending from the side and spaced from the top face in which the two first tracks are fixed;

two second tracks mounted in the table extension and respectively aligned with the two first tracks of the table, with the bottom face of the table extension comprising two grooves extending from the first side towards the second side over one half of the extension distance and spaced from the top face of the table extension and in which the two second tracks are fixed;

two supporting rods each having a first end slidably received in one of the two first tracks and a second end slidably received in one of the two second tracks with the supporting rods extending from the first face of the table extension over one half of the extension distance, with the second end of each said two supporting rods including an adjusting hole, with the adjusting hole extending perpendicular to the top faces of the table and the table extension; and means for adjusting coplanarity of the top face of the table and the top face of the table extension comprising an adjusting member adjustably received in the adjusting hole of the second end of each said supporting rod, with the adjusting member having an end abutted against the one of the two second tracks opposite to the one of the two second tracks, with the adjusting member being adjustable in a direction in the adjusting hole to space the end of the adjusting member from each said supporting rod at different spacings, with the adjusting member being moveable in the adjusting hole in the direction perpendicular to the top faces of the table and the table extension.

2. The woodworking bench as claimed in claim,1 with the table made of granite.

3. The woodworking bench as claimed in claim 2, with the table extension made of granite.

4. The woodworking bench as claimed in claim,1 with said adjusting hole being a screw hole, and with said adjusting member being a screw having an end, with the end of the screw abutting with the one of the two second tracks, with a spacing of the end of the screw from the second end of each said supporting rod changing with screwing of the screw in the screw hole.

5. The woodworking bench as claimed in claim 3, with each said supporting rod being substantially T-shaped in section, and with the first and second tracks being substantially C-shaped in section.

6. The woodworking bench as claimed in claim 2, with the base including a transmission mechanism and a cutter mechanism driven by the transmission mechanism.

7. The woodworking bench as claimed in claim 1, further comprising two screws for fixing each said first track in each said two engaging groove of the table.

8. The woodworking bench as claimed in claim 7, with the table further comprising two holes in a bottom wall defining each said engaging groove, with a sleeve being mounted in each said hole of the bottom wall and having a screw hole, with each said first track including two through-holes aligned with the screw hole of said sleeve, and with each said screw extending through one of the through-holes of each said first track into the screw hole of said sleeve.

9. The woodworking bench as claimed in claim 2, with the side of the table further comprising a plurality of fixing holes, with the table extension including an underside having a plurality of recesses, with a fastener being mounted in each of the recesses and extending into one of the fixing holes of the table.

10. The woodworking bench as claimed in claim 9, with each said recess being spaced from the side of the table extension by an end wall, with each said recess including a first, wider section adjacent to the end wall and a second, narrower section distant to the end wall, with a first sleeve being fixed in each said fixing hole of the table and having a screw hole, with a through-hole being defined in the end wall, with a second sleeve being mounted in the through-hole of the end wall and having a screw hole, with each said fastener including a threaded section extending through the screw hole of the second sleeve in the table extension into the screw hole of the first sleeve in the table.

11. The woodworking bench as claimed in claim 2, with the table and the table extension being rectangular in section.

12. The woodworking bench as claimed in claim 3, further comprising another table extension mounted to another side of the table opposite to the side of the table.

* * * * *